US009743745B2

(12) United States Patent
Duddy

(10) Patent No.: US 9,743,745 B2
(45) Date of Patent: Aug. 29, 2017

(54) OPTIMIZED CORD CLIP

(71) Applicant: LOGITECH EUROPE, S.A., Lausanne (CH)

(72) Inventor: Stephen Duddy, Moama (AU)

(73) Assignee: LOGITECH EUROPE S.A., Lausanne (CH)

( * ) Notice: Subject to any disclaimer, the term of this patent is extended or adjusted under 35 U.S.C. 154(b) by 0 days.

(21) Appl. No.: 14/873,643

(22) Filed: Oct. 2, 2015

(65) Prior Publication Data

US 2017/0095067 A1 Apr. 6, 2017

(51) Int. Cl.
*A45F 5/02* (2006.01)

(52) U.S. Cl.
CPC ..... *A45F 5/02* (2013.01); *A45F 2200/0508* (2013.01)

(58) Field of Classification Search
CPC ..... A45F 5/02; A45F 2200/0508; F16B 1/00; F16B 2001/0035; F16L 3/13; F16L 3/133; Y10T 24/1394; A44D 2203/00; A41F 1/002; A47G 1/17
USPC ..... 248/65, 206.5; 24/3.12, 303; 2/336; 224/183
See application file for complete search history.

(56) References Cited

U.S. PATENT DOCUMENTS 2,189,096 A 2/1940 Alonge
2,448,611 A * 9/1948 Stanley ..... B42D 9/004 116/234
3,155,298 A * 11/1964 Brown ..... A45D 44/06 224/268
3,529,328 A * 9/1970 Davison ..... A47G 25/485 16/87.2
3,543,724 A 12/1970 Kirkpatrick et al.
3,741,376 A * 6/1973 Brown ..... A45F 5/02 206/37
3,978,849 A 9/1976 Geneen
4,129,124 A 12/1978 Thalmann
4,224,984 A 9/1980 Cramer et al.
4,307,727 A 12/1981 Haynes
4,331,154 A 5/1982 Broadwater et al.
4,407,295 A 10/1983 Steuer et al.
4,409,983 A 10/1983 Albert
4,491,970 A 1/1985 LaWhite et al.
5,301,154 A 4/1994 Suga
(Continued)

OTHER PUBLICATIONS

"Elite Clock Military Style LED Watch" by ledwatchsuk. YouTube [dated May 31, 2011][online][retrieved on Aug. 14, 2015].
(Continued)

*Primary Examiner* — Anita M King
(74) *Attorney, Agent, or Firm* — Patterson + Sheridan LLP

(57) ABSTRACT

An optimized cord clip configured to leverage the structural features of a user's clothing to more effectively secure an audio cord. Embodiment of the present disclosure include a coupling device that serves to securely connect the strap to an audio cord, the strap itself also being securely clasped onto another item. The coupling device prevents unnecessary cord slip by employing a snap-fitting feature that securely manages the audio cord. At the same time, the clasping mechanism provided by the unique configuration of the strap, pockets, and ferromagnetic metals enables the cord clip to resist rotational forces exerted on the cord clip when a user is engaged in a physical activity imposing such forces.

25 Claims, 6 Drawing Sheets

(56) References Cited

U.S. PATENT DOCUMENTS 5,392,261 A 2/1995 Hsu
5,406,952 A 4/1995 Barnes et al.
5,524,637 A 6/1996 Erickson
5,682,653 A 11/1997 Berglof et al.
5,734,625 A 3/1998 Kondo
5,755,623 A 5/1998 Mizenko
5,899,370 A 5/1999 Bould
6,085,393 A * 7/2000 Tsui ..... A44B 99/00 24/3.12
6,104,947 A 8/2000 Heikkila et al.
6,151,968 A 11/2000 Chou
6,361,503 B1 3/2002 Starobin et al.
6,516,222 B2 2/2003 Fukuda
6,554,776 B1 4/2003 Snow et al.
6,736,759 B1 5/2004 Stubbs et al.
6,833,507 B2 * 12/2004 Arkin ..... B60R 11/00 174/135
7,192,401 B2 3/2007 Saalasti et al.
7,322,068 B1 * 1/2008 Kim ..... A47K 10/02 15/209.1
7,717,827 B2 5/2010 Kurunmaki et al.
7,914,425 B2 3/2011 Hanoun
D636,659 S 4/2011 Rothbaum et al.
D654,052 S 2/2012 Lee et al.
8,640,266 B2 * 2/2014 Best ..... A44C 15/003 2/104
8,662,682 B2 * 3/2014 Gorodisher ..... G08B 5/004 359/519
8,812,428 B2 8/2014 Mollicone et al.
8,992,385 B2 3/2015 Lemos
9,078,510 B2 * 7/2015 Liao ..... A45F 5/10
9,414,146 B2 * 8/2016 Sumsion ..... H04B 1/086
2002/0151811 A1 10/2002 Starobin et al.
2002/0188210 A1 12/2002 Aizawa
2003/0013995 A1 1/2003 Oshima et al.
2003/0065269 A1 4/2003 Vetter et al.
2005/0056655 A1 3/2005 Gary
2005/0116811 A1 6/2005 Eros et al.
2005/0256416 A1 11/2005 Chen
2006/0183980 A1 8/2006 Yang
2007/0086617 A1 * 4/2007 Loh ..... H04R 1/1033 381/374
2007/0118043 A1 5/2007 Oliver et al.
2008/0086318 A1 4/2008 Gilley et al.
2008/0132383 A1 6/2008 Einav et al.
2008/0228089 A1 9/2008 Cho et al.
2009/0312656 A1 12/2009 Lau et al.
2010/0083699 A1 * 4/2010 Conigliaro ..... A44C 15/003 63/1.18
2010/0115732 A1 * 5/2010 Honeycutt ..... H04R 5/0335 24/3.3
2010/0197463 A1 8/2010 Haughay, Jr. et al.
2011/0021319 A1 1/2011 Nissila et al.
2011/0092790 A1 4/2011 Wilder-Smith et al.
2011/0190645 A1 8/2011 Hunt et al.
2011/0252606 A1 10/2011 Rothbaum et al.
2011/0260870 A1 10/2011 Bailey
2012/0022341 A1 1/2012 Zdeblick
2012/0089553 A1 4/2012 Mollicone et al.
2012/0168471 A1 7/2012 Wilson
2012/0253485 A1 10/2012 Weast et al.
2013/0018592 A1 1/2013 Mollicone et al.
2013/0048827 A1 * 2/2013 Meier ..... A47G 19/2227 248/682
2013/0064049 A1 3/2013 Pileri et al.
2013/0237778 A1 9/2013 Rouquette
2014/0032234 A1 1/2014 Anderson
2014/0033394 A1 2/2014 Stauffer
2014/0073486 A1 3/2014 Ahmed et al.
2014/0090873 A1 4/2014 Metras et al.
2014/0107493 A1 4/2014 Yuen et al.
2014/0228175 A1 8/2014 Lemos et al.

OTHER PUBLICATIONS

"watch Stylish Blue Light LED Round Dial Matrix Stainless from ChinaBuye.com" by YnopoB. YouTube [dated Apr. 23, 2012][online][retrieved on Dec. 31, 2015] (https://www.youtube.com/watch?v=e _ LWbXHvvWg).

* cited by examiner

OPTIMIZED CORD CLIP

TECHNICAL FIELD

The present technology relates generally to the field of personal audio devices, and more particularly to securing cords used with such devices.

BACKGROUND

The use of personal audio and media devices has become pervasive in recent years. Today's audio and media devices are small enough that they can now be used in a much wider range of activities than earlier devices. Though many of these devices come equipped with internal speakers for audio playback, nearly all such devices are also equipped with an auxiliary or other port for enabling a user to connect a pair of headphones or earphones (used interchangeably throughout this disclosure) to the device. Headphones and earphone devices have further enabled users to listen to audio and other media (e.g. music, voice, etc.) while engaging in other activities. For example, if a user wants to listen to music while going for a run, they can simply put on a pair of headphones, connect the headphones to a small multimedia device (e.g. a smartphone, MP3 player, etc.) and enjoy their music while they exercise.

Most earphone and headphone devices come equipped with a cord (containing wiring) used to electronically connect the speakers in the headphones to the signal producing functionality of the multimedia device being used. When user's wish to use their multimedia devices while performing a physical activity, they often place the multimedia device in a pocket of their clothing or secure the device using an armband, wristband, etc. Thus, the cord of the headphones runs from the multimedia device clear up to the user's head where the earphones are worn. As a user performs a physical activity, however, the cord can flail about in various directions, become tangled with or caught on other objects, and inevitably tug on the earphones themselves. This results in annoyance and discomfort for the user and often requires the user to make repeated adjustments with their device or to resituate the cord. Additionally, in some cases such movement of the audio cord can cause vibrations that translate into audio interference that disturbs quality of sound the user experiences.

In more advanced earphones, the earphone housings may be configured with various sensors and circuitry that provide additional functionality (e.g. heartrate detection, motion detection, etc.). The functionality of these devices requires secure and stable placement of the earphone in a user's ear. Thus, if the cord of these devices is jostled or moved about too vigorously during an activity, it can displace an earphone from its proper position and compromise the accuracy of the sensors embedded within. This can defeat the entire purpose for using the earphones. For example, a user may wish to use earphones with biometric sensors while jogging so that they can monitor their heartrate during an exercise session. If the cord is not properly secured while the user is jogging, the cord may repeatedly tug on earphones and undermine the ability of the sensors in the earphones to obtain an accurate reading. Accordingly, there is an even greater need for cord stability when using these advanced devices. Even where wireless earphones are used (i.e. such that the cord does not run all the way to the multimedia device), however, the cord nevertheless runs between the two earphones themselves (generally resting on the back portion of a user's neck).

Movements of the cord in these devices, albeit less sever in many instances, can still give rise to the above mentioned drawbacks.

In view of these drawbacks, many attempts have been made to develop a device that can secure an audio cord to avoid tangling and other interference. However, presently available cord securing devices continue to suffer from cord slippage, as well as rotational movement of the actual device itself around the point of contact (and thereby also resulting in cord movement). Indeed, while various devices have been developed, none have been able to secure audio cords in an adequate manner; especially for advanced earphones that incorporate biometric sensors. Accordingly, a need exists for a cord securing device that employs a technical and scientific approach to solving the aforementioned problems.

BRIEF SUMMARY OF THE DISCLOSURE

In view of the above drawbacks, the present disclosure is directed toward an optimized cord clip configured to leverage the structural and mechanical features of a user's clothing to more effectively secure an audio cord. An embodiment of the present disclosure includes a coupling device that serves to securely connect a flexible strap to an audio cord, the strap itself also being securely clasped onto another item (e.g. an item of clothing the user is wearing). The coupling device (also referred to herein as the dual-channel coupling device) prevents unnecessary cord slip by employing a snap-fitting feature that securely manages the audio cord. At the same time, the clasping mechanism provided by the unique configuration of the strap, pockets, and ferromagnetic metals enables the cord clip to resist rotational forces exerted on the cord clip when a user is engaged in a physical activity imposing such forces. Exemplary embodiments of the present disclosure include a strap made of one or more flexible materials (spandex, suede, silicon, rubber, etc.) that can fold in half to clasp onto another item. The clasping force is generated by attractive forces between two or more ferromagnetic materials. The ferromagnetic materials are disposed in pockets within the strap, the pockets typically being situated near opposite ends of the strap such that when the strap folds in half, the position of the ferromagnetic materials substantially align. The point about which the strap folds is disposed within a channel of the coupling device, which in some embodiments is situated near the middle of the strap. The coupling device is in some embodiments, a rigid material, but in other embodiments may be substantially non-rigid. The coupling device is configured with at least two channels or conduits. As mentioned above, a mid-portion of the strap is situated within one of these channels, and the other channel is configured with an opening fitted to receive an audio cord in a snap-fit manner.

In particular embodiments, an optimized cord clip of the present disclosure includes two ferromagnetic units contained in pockets located near opposing ends of a flexible strap. In embodiments of the present technology, the pockets are shaped with an outer profile that is substantially square. When the optimized cord clip is properly clasped onto an item of clothing, the square geometry of the proximal side of a pocket forms a rotational interlock with the edge of the hem on a user's shirt or jacket or other item of apparel. The additional leverage provided by the rotationally interlocked arrangement of the two edges (e.g. the proximal side edge of a pocket formed in the strap, situated adjacent to the bottom edge of a hem on the collar of a user's shirt) minimizes the overall movement and rotation of the clip, and therefore overall movement of the audio cord itself. The optimized design of the cord clip minimizes rotation of the cord clip about a collar and further minimizes other movements. While embodiments of the present technology are described in connection with earphone and headphone devices, the optimized cord clip technology disclosed herein may also be applied to other cords, strings, cables, etc. that users need secured (e.g. the cord connecting noise-canceling earplugs, or spectacle security cords, etc.).

BRIEF DESCRIPTION OF THE DRAWINGS

The technology disclosed herein, in accordance with one or more various embodiments, is described in detail with reference to the following figures. The drawings are provided for purposes of illustration only and merely depict typical or example embodiments of the disclosed technology. These drawings are provided to facilitate the reader's understanding of the disclosed technology and shall not be considered limiting of the breadth, scope, or applicability thereof. It should be noted that for clarity and ease of illustration these drawings are not necessarily made to scale.

Figure 1B:
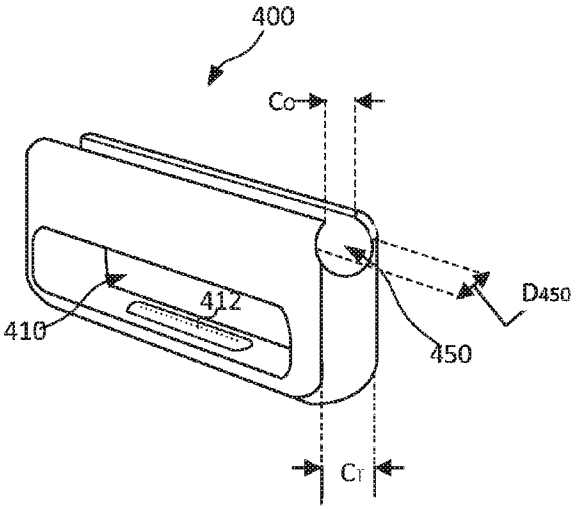
FIG. 1B is a schematic of a dual-channel coupler detached from the strap of a cord clip in accordance with an embodiment of the disclosed technology.

The figures are not intended to be exhaustive or to limit the disclosure to the precise form disclosed. The figures are not drawn to scale. It should be understood that the disclosed technology can be practiced with modification and alteration, and that the disclosed technology may be limited only by the claims and the equivalents thereof.

DETAILED DESCRIPTION OF THE EMBODIMENTS

The technology disclosed herein is directed toward an optimized cord clip for securing a cord of an audio earphone or headphone device being worn by a user. In particular, an optimized cord clip of the present disclosure includes two ferromagnetic units contained in pockets located within and near opposing ends of a flexible strap. In embodiments of the present technology, the pockets are configured with an outer profile that is substantially square. When the optimized cord clip is properly clasped onto an item of clothing, the square geometry of a proximal side of a pocket forms a rotational interlock with the edge of the hem on a user's shirt or jacket or other item of apparel. The additional leverage provided by the rotationally interlocked arrangement of the two edges (e.g. the proximal side edge of a pocket formed in the strap, situated adjacent to the bottom edge of a hem on the collar of a user's shirt) minimizes the overall movement and rotation of the clip, and therefore the overall movement of the audio cord itself. The reduced movement of the cord results in an enhanced user experience, and increased quality of entertainment.

In some embodiments, the optimized cord clip of the present disclosure includes a dual-channel coupler configured to: (i) couple the audio cord to the strap (which is clasped onto the user's apparel), and (ii) minimize sliding of the cord within the optimized cord clip device to avoid disruption to the user. The optimized design of the cord clip of the present disclosure accomplishes both; it minimizes rotation of the cord clip about a collar (and thereby movement of the cord in the same manner), and further minimizes slipping of the cord that may otherwise lead to displacement or complete dislodgement of an earphone from a user's ear. While embodiments of the present technology are described in connection with earphone and headphone devices, the optimized cord clip technology disclosed herein may also be applied to other cords, strings, cables, etc. that users need secured (e.g. the cord connecting noise-canceling earplugs, or spectacle security cords, etc.).

The optimized cord clip of the present disclosure includes a strap and a coupler, the coupler being able to secure both the strap and a cord of an audio device. FIG. 1A is a schematic of a disassembled cord clip strap, and components enclosed therein in accordance with an embodiment of the disclosed technology. The strap 100 includes a first layer 200 formed with pockets 210 and 220, two fitted cushions 503 and 504 formed with apertures 510 and 520, two ferromagnetic units (e.g. magnetized disks or pellets) 512 and 522, and second layer 300. In some embodiments, ferromagnetic units 512 and 522 may be situated in apertures 510 and 520 of fitted cushions 503 and 504; fitted cushions 503 and 504 may be further situated in pockets 210 and 220 formed in layer 200 of strap 100. A second layer 300 may then be mechanically coupled to first layer 200 such that second layer 300 substantially covers the apertures formed in strap 100 by pockets 210 and 220 of first layer 200, thereby enclosing and securing fitted cushions 503 and 504 and ferromagnetic units 512 and 522 in an interior portion of strap 100. As discussed in more detail below, the fully assembled cord clip is optimized to fold the strap about a pivot point (e.g. the dual-channel coupler) so that opposite ends of strap 100 clasp together around a portion of a user's clothing, held together via magnetic force generated by ferromagnetic units 512 and 522.

In some embodiments, no cushions 503, 504 are used to secure ferromagnetic units 512 and 522 within pockets 210 and 220. In other embodiments the ferromagnetic units are secured without fitted cushions 503 and 504 because the shape of the ferromagnetic units 512 and 522 substantially matches the profile of pockets 210 and 220 respectively. In still further embodiments, one of the ferromagnetic units is magnetized and the other is not.

As illustrated in FIG. 1A, in some embodiments the strap 100 is formed with one or more notches 222 and 333, the notches located substantially near the point about which the strap will bend when in a closed configuration during use. As depicted, notches 222 and 333 are configured to secure a mid-portion of strap 100 within a channel 410 of dual channel coupler 400 of FIG. 1B when the optimized cord clip device of the present disclosure is assembled.

Although FIG. 1A depicts strap 100 being formed with two separate layers, 200 and 300, in some embodiments strap 100 is formed from a single piece of material (e.g. compression mold, etc.). However, in embodiments that employ a multilayer approach, such layers may be coupled together in a variety of methods known in the art (e.g. adhesives, plastic weld, etc.). Indeed, it should be noted that the technology disclosed herein is not limited to the figures and examples provided. As will be appreciated by one of ordinary skill in the art, there are many aspects and modifications that may be made to the optimized cord clips depicted in the figures without departing from the scope of this disclosure. For example, a wide variety of materials may be used in a vast array of sizes in employing this technology. For instance, the strap 100 may include one or more flexible and/or rigid materials well-known in the art (e.g. flexible silicone strap formed with rigid plastic pockets, or a spandex top layer with a suede bottom layer, etc.), and the dual-channel coupler may be formed from a rigid plastic, metal, or other suitable material.

Figure 1A:
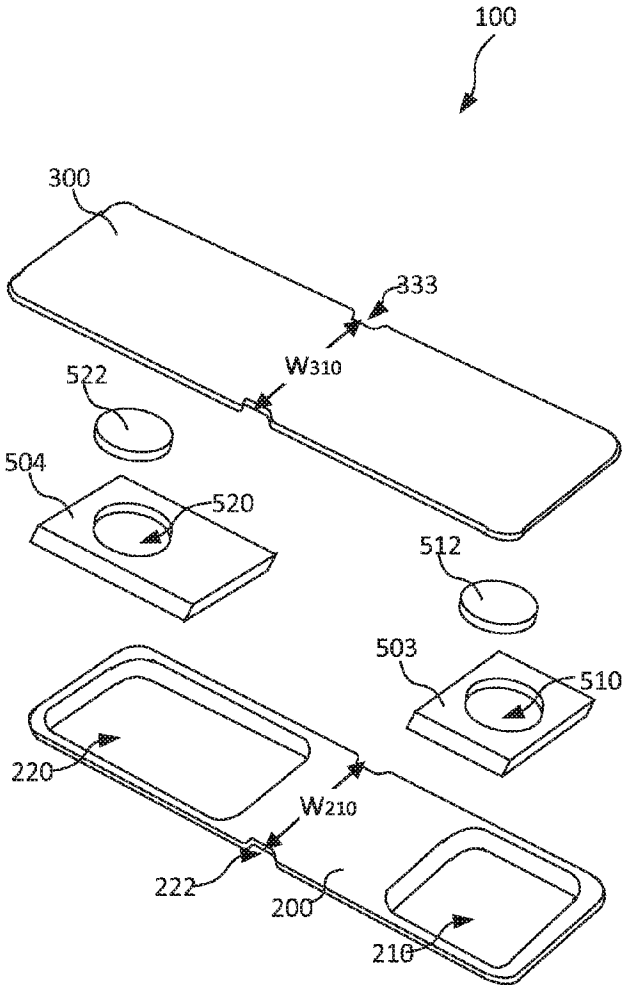
FIG. 1A is a schematic of a disassembled cord clip strap, and the components enclosed therein, in accordance with an embodiment of the disclosed technology.

FIG. 1B is a perspective view of a dual-channel coupler in accordance with one embodiment of the disclosed technology. As illustrated, dual-channel coupler 400 is formed with a first channel 410 traversing the thickness dimension, CT, of dual-channel coupler 400 and running in a substantially perpendicular direction to longitudinal axis of second channel 450.

First channel 410 is configured to receive and secure strap 100. In particular embodiments, such as the one depicted, strap 100 is notched, the width dimension of first channel 410 substantially matching the outer width dimension of notched portion of strap 100, and the height dimension of first channel 410 substantially matching the thickness, $T_{100}$, of strap 100, the notched portion of strap 100 being defined by the combination of notched portion 222 of first layer 220 and notched portion 333 of second layer 300 when combined to form strap 100. In embodiments, the first channel 410 is formed to substantially match the outer profile of a portion of strap 100 to hold strap 100 in place during use. In particular, width dimensions $W_{210}$ of first layer 200 and $W_{310}$ and second layer 300 fit (either in a relaxed or compressed state) within first channel 410 of dual-channel coupler 400. Additionally, thickness dimension $T_{100}$ of strap 100 fits (either in a relaxed or compressed state) within first channel 410 of dual-channel coupler 400.

In still further embodiments, one or more of first layer 200 and second layer 300 is made of a compressible material (e.g. memory foam, silicone, rubber, spandex, suede, etc.), and the thickness of strap 100 is equal to or greater than the height dimension of first channel 410 before a portion of strap 100 is positioned within first channel 410. When strap 100 is positioned within channel 410, the compressible materials of strap 100 may be compressed by the rigid inside wall of channel 410. In some embodiments, this compression increases the outward force applied to the interior wall of first channel 410, and likewise increases the inward force applied to the portion of the strap 100 in contact with the inside wall of the first channel 410. The increased force increases the friction between strap 100 and first channel 410 in accordance with the well-known equation, $Fr=\mu N$, where Fr is the resistive force of friction, $\mu$ is the coefficient of friction for the two surfaces, N is the normal or perpendicular force between the two objects. Because friction increases with force, embodiments that employ compressible materials in forming strap 100 may realize further positional security and stability of strap 100 within channel 410. Consequently, greater stability may be realized for the audio cord as well. In some embodiments the first channel 410 is formed with a ridge 412 within first channel 410 to ensure there is sufficient compressive force applied to strap 100 to hold the strap 100 in place when a portion of strap 100 is disposed within the first channel 410.

As illustrated, second channel 450 runs along a distal edge of the coupler 400 in the longitudinal direction substantially orthogonal to first channel 410. As depicted, second channel 450 is partially open and configured to receive an audio cord in a snap-fit manner. In particular, second channel 450 has a diameter, $D_{450}$, that substantially matches the diameter of an audio cord. The second channel 450 is also configured with a partially open side having a dimension, $C_O$, measuring smaller than the diameter of an audio cord. With sufficient force, an audio cord may be pressed into second channel 450 such that the audio cord is held snug in place by the interior wall of second channel 450.

Figure 2C:
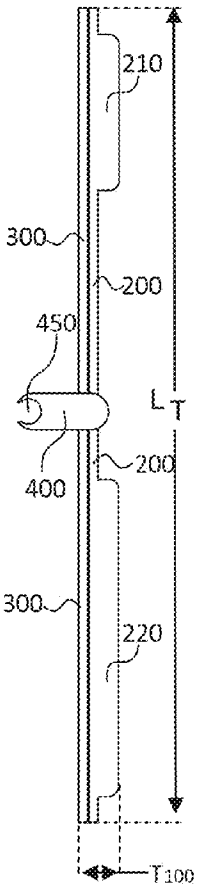
FIG. 2C is a side view of a cord clip, in an open configuration, in accordance with an embodiment of the disclosed technology.
Figure 2B:
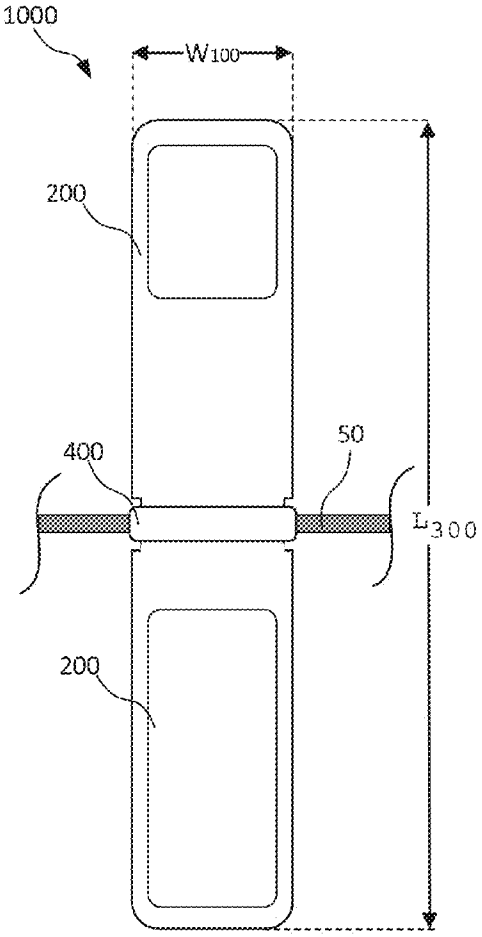
FIG. 2B is a bottom view of a cord clip, in an open configuration, in accordance with an embodiment of the disclosed technology.
Figure 2A:
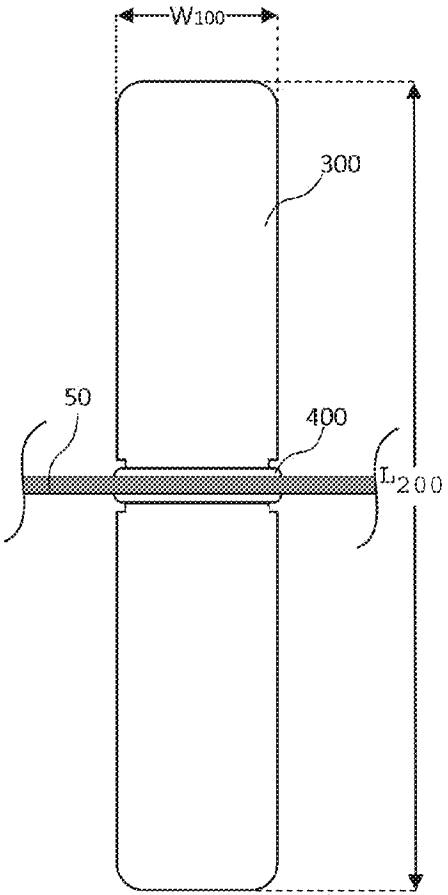
FIG. 2A is a top view of a cord clip, in an open configuration, in accordance with an embodiment of the disclosed technology.

FIG. 2A is a top view of a cord clip in accordance with one embodiment of the disclosed technology, the cord clip depicted in an open configuration. FIG. 2B is a bottom view of the cord clip depicted in FIG. 2A, and FIG. 2C is a side view of the same embodiment of the cord clip, also in an open configuration for clarity of discussion. As illustrated in FIGS. 2A-2C and discussed above in connection with FIG. 1B, dual-channel coupler 400 of cord clip 1000 is configured with a second channel 450 to receive and secure cord 50 in a snap-fit manner. As further illustrated, dual-channel coupler 400 of cord clip 1000 is configured with a first channel 410 to receive and secure strap 100 in a substantially orthogonal direction relative to the longitudinal axis of cord 50 when it is situated in second channel 450. In some embodiments, width dimension $W_{100}$ of strap 100 is uniform across the length of the strap 100. In other embodiments, a portion of strap 100 is configured with one or more notches, wherein the width dimension of the strap 100 at the notched portion is smaller than the width dimension $W_{100}$ of the remainder of strap 100.

Figure 3B:
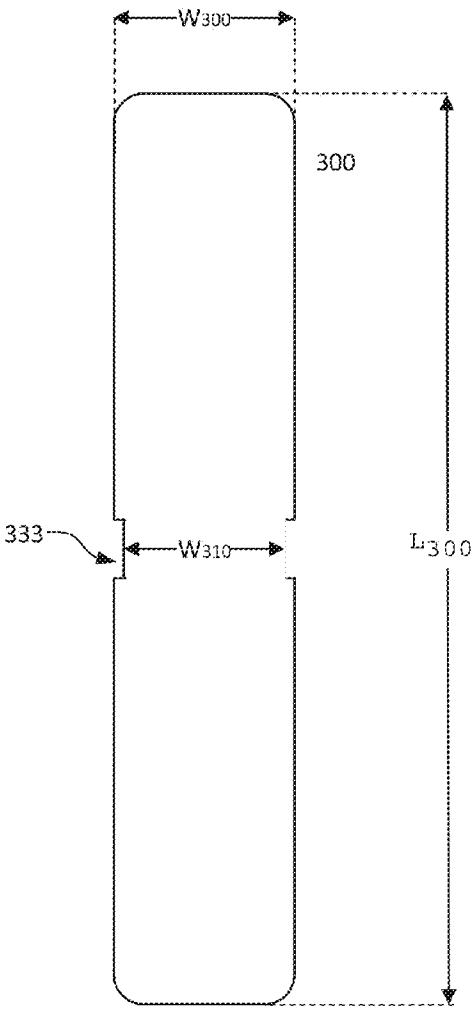
FIG. 3B is a top view of a second layer of a strap used in a cord clip in accordance with an embodiment of the disclosed technology.
Figure 3A:
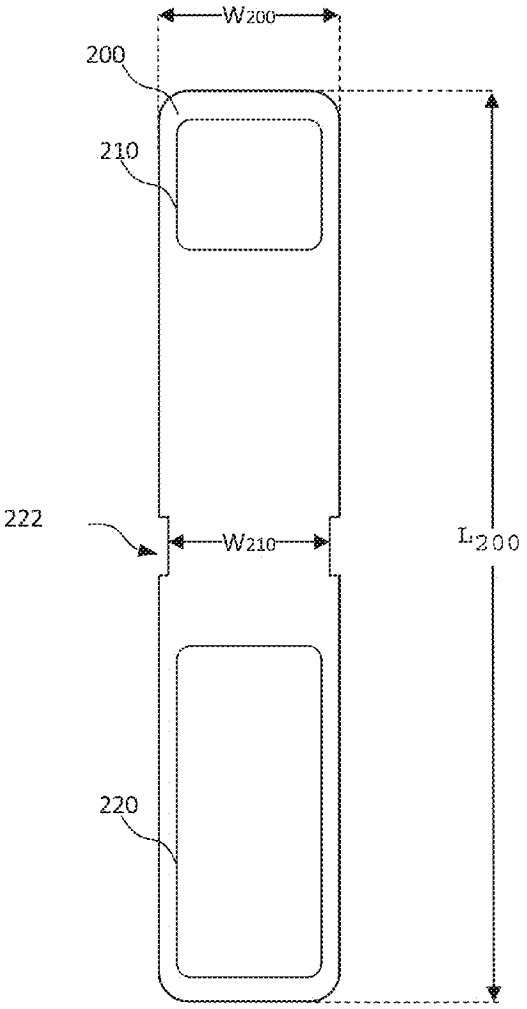
FIG. 3A is a top view of a first layer of a strap used in a cord clip in accordance with an embodiment of the disclosed technology.

FIG. 3A is a top view of a first layer of a strap used in a cord clip in accordance with one embodiment of the disclosed technology. FIG. 3B is a top view of a second layer of a strap used in a cord clip in accordance with one embodiment of the disclosed technology. As depicted, in some embodiments the outer profile of first layer 200 matches the outer profile of second layer 300. In this embodiment, width dimension $W_{200}$ of first layer 200 is approximately the same as width dimension $W_{300}$ of second layer 300; width dimension $W_{210}$ of notched portion of first layer 200 is approximately the same as width dimension $W_{310}$ of notched portion of second layer 300; and length dimension $L_{200}$ of first layer 200 is approximately the same as length dimension $L_{300}$ of second layer 300. In embodiments the width dimensions $W_{200}$ and $W_{300}$ is about between 15 and 25 millimeters, and the length dimensions $L_{200}$ and $L_{300}$ is about between 65 and 75 millimeters.

Figure 4B:
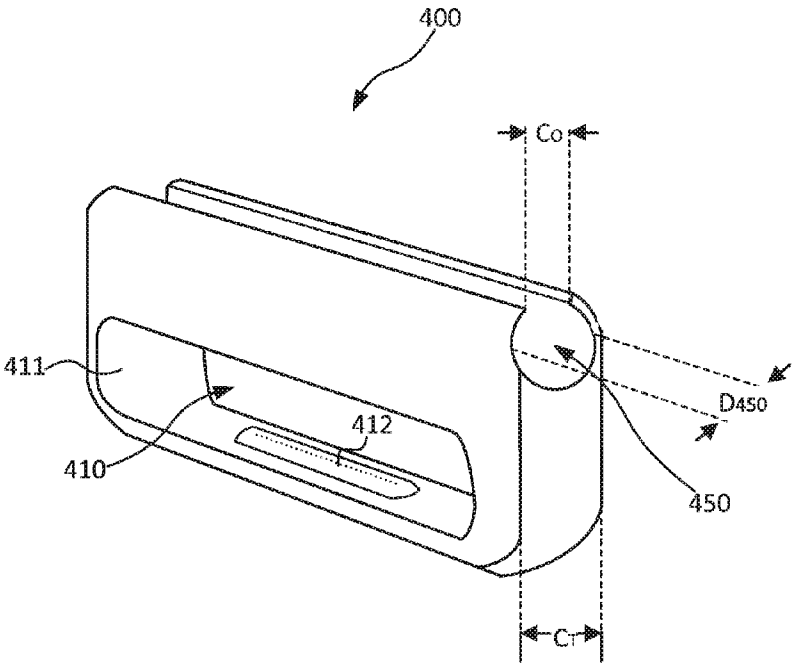
FIG. 4B is a perspective view of a dual-channel coupler used in a cord clip in accordance with an embodiment of the disclosed technology.
Figure 4A:
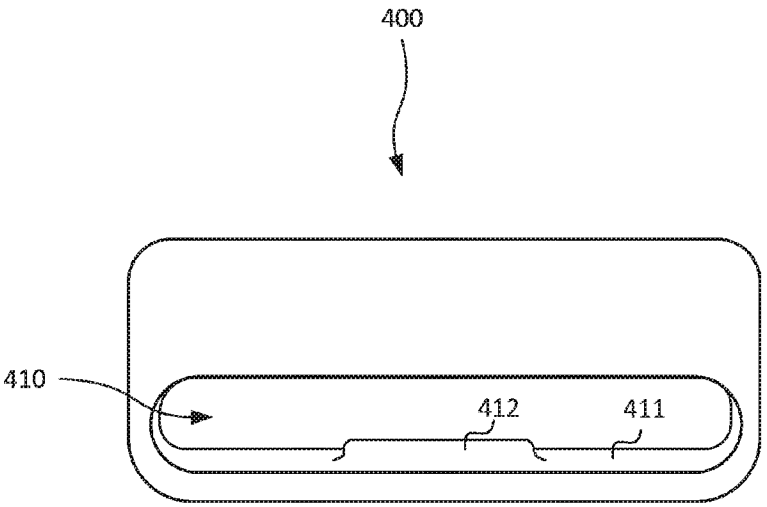
FIG. 4A is a side view of a dual-channel coupler used in a cord clip in accordance with an embodiment of the disclosed technology.

FIG. 4A is a magnified side view of a dual channel coupler component of an optimized cord clip in accordance with one embodiment of the disclosed technology. FIG. 4B is a perspective view of a dual channel coupler component of an optimized cord clip in accordance with one embodiment of the disclosed technology. As depicted, dual-channel coupler 400 is formed with a first channel 410 traversing the thickness dimension, CT, of coupler 400 and running in a substantially perpendicular direction to second channel 450; second channel 450 running along a distal edge of dual-channel coupler 400 in a substantially longitudinal direction.

First channel 410 is configured to receive and secure strap 100. Interior wall 411 of first channel 410 may be configured to substantially match an outer profile of a portion of strap 100 when strap 100 is situated within first channel 100 as depicted in FIGS. 2A-2C. In particular, width dimensions $W_{210}$ of first layer 200 and $W_{310}$ and second layer 300 are collectively less than or equal to the thickness dimension of first channel 410 of dual-channel coupler 400 when strap 100 is situated within channel 410. In other words, the thickness dimension $T_{100}$ of strap 100 fits (either in a relaxed or compressed condition) within first channel 410 of dual-channel coupler 400.

When the strap 100 is positioned within channel 410, the compressible materials of strap 100 are compressed by the inside wall of channel 410. In some embodiments, this compression increases the outward force applied to the interior wall of the first channel 410, and likewise increases the inward force applied to the portion of the strap 100 in contact with the inside wall of the first channel 410. The increased force increases the friction between strap 100 and first channel 410 in accordance with the previously recited equation, $Fr=\mu N$, where Fr is the resistive force of friction, $\mu$ is the coefficient of friction for the two surfaces, N is the normal or perpendicular force between the two objects. Because friction increases with force, embodiments that employ compressible materials in forming strap 100 realize further positional security and stability of strap 100 within channel 410. In some embodiments the inside wall 411 of the first channel 410 includes a ridge 412 protruding into the aperture that forms first channel 410. Strap 100 is situated through first channel 410 when the cord clip 1000 is assembled, and ridge 412 within first channel 410 ensures there is sufficient compressive force applied to strap 100 to hold strap 100 in place. In some embodiments the dimensions of the channel 410 relative to the outer profile dimension of the notched portion of the strap 100 are such that ridge 412 is unnecessary. In other embodiments, the dimensions of the strap 100 otherwise fit too loosely within the channel 410, and the added functionality of the ridge 410 becomes critical to inhibiting movement. In particular, the increased force on strap 100 created by ridge 412 increases the friction between the surface of the strap 100 that is in contact with the interior wall 411 of channel 410. The increased friction results minimizes movement of the strap 100 within the first channel 410 and enables the optimized cord clip assembly to maintain its functionality.

As illustrated in FIG. 4B, second channel 450 runs along a distal edge of the coupler 400 in the longitudinal direction substantially orthogonal to the direction traversed by the first channel 410. As depicted, second channel 450 is partially open and configured to receive an audio cord in a snap-fit manner. In particular, second channel 450 has an inside diameter, $D_{450}$, that substantially matches the outside diameter of an audio cord. However the dimension $C_O$ of the partial opening along the length of second channel 450 is, in some embodiments, less than the outside diameter of an audio cord. With sufficient force, an audio cord may be pressed into second channel 450 such that the audio cord is held snug in place by the interior wall of second channel 450. That is, when a user attempts to press an audio cord into channel 450 via the partial opening defined by dimension $C_O$ in FIG. 4B, one or more of (i) the cord material, or (ii) the material forming the channel 450, may temporarily flex or compress such that the audio cord may settle within channel 450 resulting in a snug fit. Similarly, when a user attempts to remove an audio cord from channel 450, a sufficient amount of force will incur the same or similar flexure and compression. Accordingly, an audio cord may be releasably coupled to cord clip 1000 via channel 450 of dual-channel coupler 400. The snap-fit type design for the cord clip of the presently disclosed technology minimizes slippage and enhances the security and stability of the audio cord's position.

Figure 5A:
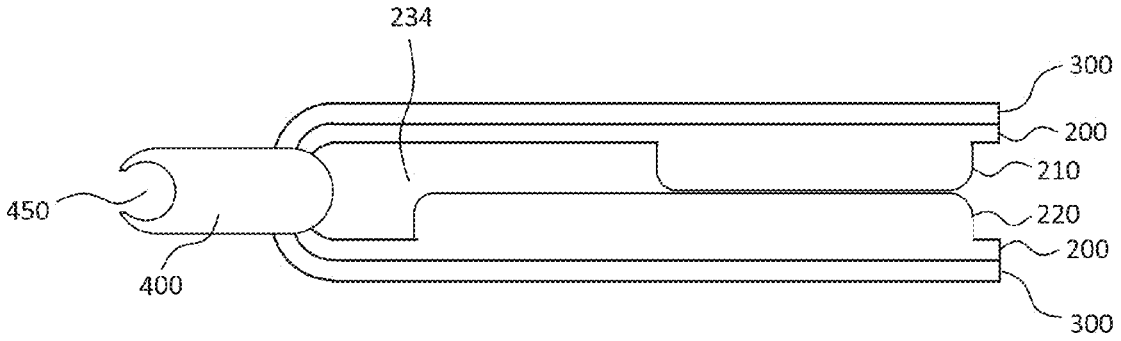
FIG. 5A is a side view of a cord clip in a closed configuration in accordance with an embodiment of the disclosed technology.

FIG. 5A is a side view of a cord clip in a closed configuration in accordance with one embodiment of the disclosed technology. The closed configuration embodiment depicted in FIG. 5A illustrates how cord clip 1000 functions to minimize rotation and other cord movements. The closed configuration is held in place by the attractive forces between the ferromagnetic units disposed in pocket 210 and pocket 220 when brought close together. As depicted, the closed configuration of optimized cord clip 1000 defines a new aperture 234. The formation of aperture 234 is provided to allow the hemmed collar of a t-shirt or other hemmed portion of other apparel to be situated therein. As will be discussed in more detail with reference to FIGS. 6A-6C, the square edge of pocket 210 is designed to situate adjacent to the edge of a t-shirt hem when the cord clip is worn by a user, such that neither the cord clip nor the shirt collar can rotate relative to the other. In some embodiments, the cord clip is designed to utilize the structure provided by a tee-shirt (or other apparel) to minimize cord movement while securing the cord to the user's apparel.

Figure 5B:
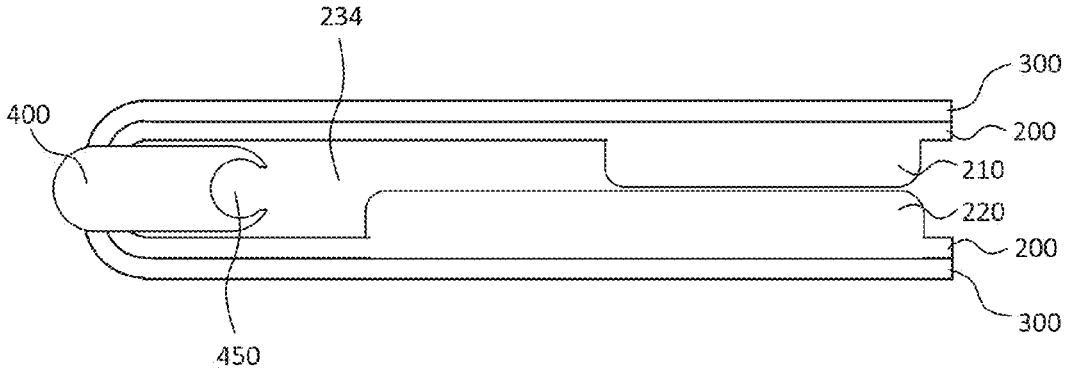
FIG. 5B is a side view of another cord clip in a closed configuration in accordance with an embodiment of the disclosed technology.

FIG. 5B is a side view of a cord clip in another closed configuration in accordance with one embodiment of the disclosed technology. FIG. 5B is similar to 5A, but illustrates an additional configuration, where the second channel 450 of cord clip 1000 is facing the inside of the cord clip when in the closed position. In some instances a user may wish to employ such a configuration to further secure an audio cord. In such embodiments, the total length $L_T$ of strap 100 is slightly longer, ranging from 70-90 mm in length, to ensure that the dual-channel coupler 400 does not obstruct aperture 234 in a manner that precludes the interlocking feature to occur as between the edges of the pocket 210 and hem.

Figure 6C:
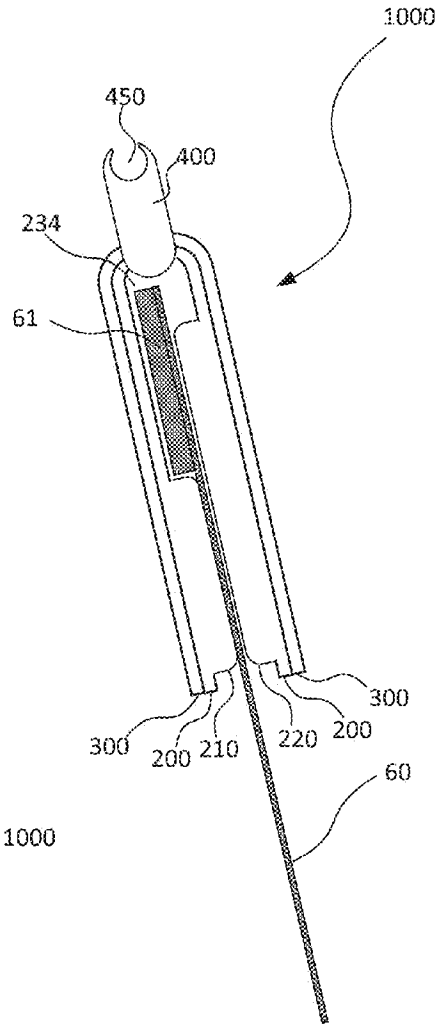
FIG. 6C is a magnified cross-sectional view of the cord clip depicted in FIGS. 6A-6B, in accordance with an embodiment of the disclosed technology.
Figure 6B:
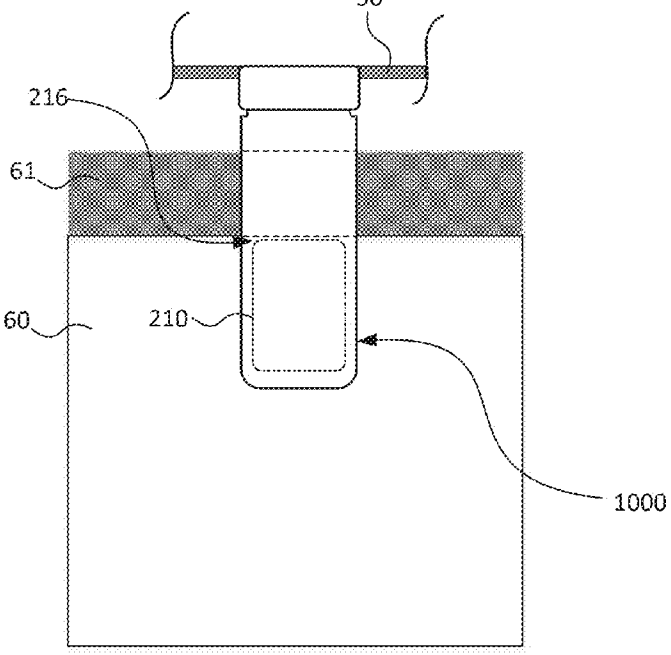
FIG. 6B is a schematic diagram illustrating a magnified view of the cord clip depicted in FIG. 6A as it is attached to apparel in accordance with an embodiment of the disclosed technology.
Figure 6A:
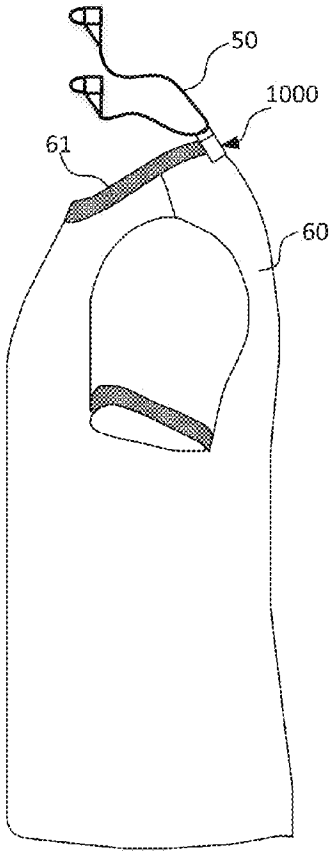
FIG. 6A is a side view of a tee-shirt with a cord clip attached thereto in accordance with an embodiment of the disclosed technology.

FIG. 6A is a side view of a tee-shirt with a cord clip attached thereto in accordance with the technology disclosed herein. As illustrated, optimized cord clip 1000 may clasp around the edge of a collar 61 of tee shirt 60. In exemplary embodiments, hem 61 of shirt 60 fits within aperture 234 such that the top edge 216 of pocket 210 or 220 aligns with the bottom edge of a hem 61. In this arrangement, hem 61 provides structure which cord clip 1000 can leverage in order to resist rotational and other forces. In other embodiments, edge of hem 61 may not necessarily align (e.g. in parallel) with an edge of pocket 210 or 220, but the apparel may be gathered into aperture 234 in a manner that provides similar such structure for cord clip to leverage when resisting rotational and other forces. FIG. 6B is a schematic diagram illustrating a magnified view of the cord clip shown in FIG. 6A, symbolically depicting the location of pocket 210 and hem 61 of shirt 60 in accordance with an embodiment of the technology disclosed herein. As illustrated, a bottom edge of hem 61 substantially aligns with top edge of pocket 210. Because neither edge is rounded, rotational movement of the shirt 60, hem 61 and cord clip 1000 with respect to one another is minimized.

FIG. 6C is a magnified cross-sectional view of the cord clip shown in FIGS. 6A and 6B, here depicting several of the layers discussed earlier in connection with FIGS. 1A-3B. First layer 200 and second layer 300 are coupled together; pockets 210 and 220 are situated on the same side of first layer 200 such that they may come in contact with one another when the attractive force between the ferromagnetic units is engaged. When worn by a user, cord clip 1000 clasps a portion of a user's apparel (e.g. tee-shirt 60) such that a portion of the collar or hem of the user's apparel is disposed within an aperture 234 defined in part by the interior portion of first layer 200 when the cord clip is in a closed position. The outside portion of pocket 210 and pocket 220 come in direct contact with user's apparel, and exert compressive force on the material that further inhibits rotational and other movements.

While various embodiments of the disclosed technology have been described above, it should be understood that they have been presented by way of example only, and not of limitation. Likewise, the various diagrams may depict an example architectural or other configuration for the disclosed technology, which is done to aid in understanding the features and functionality that can be included in the disclosed technology. The disclosed technology is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the technology disclosed herein.

Although the disclosed technology is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the disclosed technology, whether or not such embodiments are described and whether or not such features are presented as being a part of a described embodiment. Thus, the breadth and scope of the technology disclosed herein should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed in multiple groupings or packages or across multiple locations.

I claim:

1. A cord clip apparatus, comprising:

a strap formed with two or more pockets;

a first ferromagnetic component disposed in a first pocket;

a second ferromagnetic component disposed in a second pocket;

a dual channel coupler comprising a first channel and a second channel, wherein a portion of the strap is disposed within a portion of the first channel; and wherein the second channel is fitted to receive and partially surround an audio cord, wherein the strap is formed of a flexible material such that the strap is configured to be folded in half, enabling the first ferromagnetic component disposed at least partially within the first pocket to be brought into magnetic contact with the second ferromagnetic component disposed at least partially within the second pocket; and an aperture disposed between the folded sides of the strap when the first ferromagnetic component is brought into magnetic contact with the second ferromagnetic component, wherein the second channel is disposed at least partially within the aperture.

2. The cord clip apparatus according to claim 1, wherein the second channel is disposed at least partially outside the aperture.

3. The cord clip apparatus according to claim 1, wherein:

a hemmed portion of an item of apparel is configured to be disposed within the aperture such that the hemmed portion is adjacent to and substantially parallel with at least one side of one pocket of the strap; and further wherein the strap clasps a second portion of the item of apparel such that the second portion is disposed between the pockets containing the ferromagnetic components.

4. The cord clip apparatus according to claim 3, wherein:

the hemmed portion of the item of apparel is a collar.

5. The cord clip apparatus according to claim 3, wherein:

the hemmed portion of the item of apparel is a portion of a shirt.

6. The cord clip apparatus according to claim 1, wherein:

a smallest diameter of the second channel is between 0.5 and 10 millimeters.

7. The cord clip apparatus according to claim 1, wherein:

a width dimension of the strap is between 15 and 25 millimeters.

8. The cord clip apparatus according to claim 1, wherein:
a total length of the strap is between 60 and 95 millimeters.

9. The cord clip apparatus according to claim 1, wherein:
a total thickness of the strap is between 1 and 10 millimeters.

10. A cord clip apparatus, comprising:
a strap formed with two or more pockets;
a first ferromagnetic component disposed in a first pocket;
a second ferromagnetic component disposed in a second pocket;
a dual channel coupler comprising a first channel and a second channel, wherein a portion of the strap is disposed within a portion of the first channel, and the second channel is fitted to receive and partially surround an audio cord; and
one or more fitted cushions disposed in at least one of the two or more pockets.

11. The cord clip apparatus according to claim 10, wherein:
at least one of the fitted cushions are formed with an aperture having an interior profile that substantially matches and outer profile of at least one of the one or more ferromagnetic components.

12. The cord clip apparatus according to claim 10, wherein:
the one or more fitted cushions are made of a non-rigid material.

13. A cord clip apparatus, comprising:
a strap formed with two or more pockets;
a first ferromagnetic component disposed in a first pocket;
a second ferromagnetic component disposed in a second pocket;
a dual channel coupler comprising a first channel and a second channel, wherein a portion of the strap is disposed within a portion of the first channel, and the second channel is fitted to receive and partially surround an audio cord, and wherein:
the strap comprises a first portion formed with the two or more pockets exposed through one or more apertures on one side of the first portion; and a second portion; and
the first and second portions are mechanically coupled together.

14. The cord clip apparatus according to claim 13, wherein:
the second portion has a profile in one dimension that substantially matches the profile of the first portion in the same dimension.

15. A cord clip apparatus, comprising:
a strap formed with two or more pockets;
a first ferromagnetic component disposed in a first pocket;
a second ferromagnetic component disposed in a second pocket;
a dual channel coupler comprising a first channel and a second channel, wherein a portion of the strap is disposed within a portion of the first channel, and the second channel is fitted to receive and partially surround an audio cord, and wherein:
the strap is formed of a flexible material such that the strap is configured to be folded in half, enabling the first ferromagnetic component disposed at least partially within the first pocket to be brought into magnetic contact with the second ferromagnetic component disposed at least partially within the second pocket; and
an aperture disposed between the folded sides of the strap when the first ferromagnetic component is brought into magnetic contact with the second ferromagnetic component, wherein the second channel is disposed at least partially within the aperture; and
wherein a hemmed portion of an item of apparel is configured to be disposed within the aperture such that the hemmed portion is adjacent to and substantially parallel with at least one side of one pocket of the strap; and further wherein the strap clasps a second portion of the item of apparel such that the second portion is disposed between the pockets containing the ferromagnetic components.

16. The cord clip apparatus according to claim 15, wherein the second channel is disposed at least partially outside the aperture.

17. The cord clip apparatus according to claim 15, wherein:
a smallest diameter of the second channel is between 0.5 and 10 millimeters.

18. The cord clip apparatus according to claim 15, wherein:
a width dimension of the strap is between 15 and 25 millimeters.

19. The cord clip apparatus according to claim 15, wherein:
a total length of the strap is between 60 and 95 millimeters.

20. The cord clip apparatus according to claim 15, wherein:
a total thickness of the strap is between 1 and 10 millimeters.

21. A cord clip apparatus, comprising:
a strap formed with two or more pockets;
a first ferromagnetic component disposed in a first pocket;
a second ferromagnetic component disposed in a second pocket;
one or more fitted cushions disposed in at least one of the two or more pockets;
a dual channel coupler comprising a first channel and a second channel, wherein a portion of the strap is disposed within a portion of the first channel; and the second channel is fitted to receive and partially surround an audio cord, and wherein:
the strap is formed of a flexible material such that the strap is configured to be folded in half, enabling the first ferromagnetic component disposed at least partially within the first pocket to be brought into magnetic contact with the second ferromagnetic component disposed at least partially within the second pocket; and
an aperture disposed between the folded sides of the strap when the first ferromagnetic component is brought into magnetic contact with the second ferromagnetic component; and
wherein a hemmed portion of an item of apparel is configured to be disposed within the aperture such that the hemmed portion is adjacent to and substantially parallel with at least one side of one pocket of the strap; and further wherein the strap clasps a second portion of the item of apparel such that the second portion is disposed between the pockets containing the ferromagnetic components.

22. The cord clip apparatus according to claim 21, wherein:
at least one of the fitted cushions are formed with an aperture having an interior profile that substantially matches and outer profile of at least one of the one or more ferromagnetic components.

23. The cord clip apparatus according to claim 21, wherein:

the one or more fitted cushions are made of a non-rigid material.

24. A cord clip apparatus comprising:

a strap formed with two or more pockets;

a first ferromagnetic component disposed in a first pocket;

a second ferromagnetic component disposed in a second pocket;

a dual channel coupler comprising a first channel and a second channel, wherein a portion of the strap is disposed within a portion of the first channel; and wherein the second channel is fitted to receive and partially surround an audio cord, wherein:

the strap is formed of a flexible material such that the strap is configured to be folded in half, enabling the first ferromagnetic component disposed at least partially within the first pocket to be brought into magnetic contact with the second ferromagnetic component disposed at least partially within the second pocket; and an aperture disposed between the folded sides of the strap when the first ferromagnetic component is brought into magnetic contact with the second ferromagnetic component;

wherein a hemmed portion of an item of apparel is configured to be disposed within the aperture such that the hemmed portion is adjacent to and substantially parallel with at least one side of one pocket of the strap; and further wherein the strap clasps a second portion of the item of apparel such that the second portion is disposed between the pockets containing the ferromagnetic components, and wherein:

the strap comprises a first portion formed with the two or more pockets exposed through one or more apertures on one side of the first portion; and a second portion, wherein the first and second portions are mechanically coupled together.

25. The cord clip apparatus according to claim 24, wherein:

the second portion has a profile in one dimension that substantially matches the profile of the first portion in the same dimension.

* * * * *